US007754050B2

(12) United States Patent
Redd et al.

(10) Patent No.: US 7,754,050 B2
(45) Date of Patent: Jul. 13, 2010

(54) FIBROUS STRUCTURES COMPRISING A TUFT

(75) Inventors: Charles Allen Redd, Harrison, OH (US); Steven Lee Barnholtz, West Chester, OH (US); Lois Jean Forde-Kohler, Cincinnati, OH (US); Kevin Benson McNeil, Loveland, OH (US); Matthew Todd Hupp, Cincinnati, OH (US); Gregory William Duritsch, West Harrison, IN (US)

(73) Assignee: The Procter + Gamble Company, Cincinnati, OH (US)

( * ) Notice: Subject to any disclaimer, the term of this patent is extended or adjusted under 35 U.S.C. 154(b) by 981 days.

(21) Appl. No.: 11/129,846

(22) Filed: May 16, 2005

(65) Prior Publication Data

US 2005/0279470 A1 Dec. 22, 2005

Related U.S. Application Data

(60) Provisional application No. 60/581,647, filed on Jun. 21, 2004.

(51) Int. Cl.
*D21H 27/30* (2006.01)
*D21H 27/38* (2006.01)
*D21H 27/42* (2006.01)

(52) U.S. Cl. ..... 162/125; 162/129; 162/117; 162/141; 162/146; 162/157.1; 162/157.3; 428/172; 428/86; 428/91

(58) Field of Classification Search ..... 162/109, 162/111–113, 115–117, 123–133, 141, 146, 162/149, 157.1, 157.3; 428/85–86, 91–92, 428/156, 88, 172; 442/381, 394
See application file for complete search history.

(56) References Cited

U.S. PATENT DOCUMENTS

| | | | | |
|---|---|---|---|---|
| 3,243,861 | A * | 4/1966 | Kumin et al. | 28/109 |
| 3,337,388 | A | 8/1967 | Wosaba II | |
| 3,511,740 | A | 5/1970 | Sanders | |
| 3,542,634 | A * | 11/1970 | Such et al. | 428/135 |
| 3,684,284 | A | 8/1972 | Tranfield | |
| 3,695,270 | A | 10/1972 | Dostal | |
| 3,908,659 | A | 9/1975 | Wehrmeyer | |
| 3,960,652 | A | 6/1976 | Conway et al. | |
| 4,042,453 | A | 8/1977 | Conway | |
| 4,116,892 | A * | 9/1978 | Schwarz | 521/62 |
| 4,223,063 | A * | 9/1980 | Sabee | 442/400 |
| 4,379,799 | A | 4/1983 | Holmes | |
| 4,465,726 | A | 8/1984 | Holmes | |

(Continued)

FOREIGN PATENT DOCUMENTS

EP 0 963 747 A1 12/1999

(Continued)

OTHER PUBLICATIONS

U.S. Appl. No. 11/129,877, filed May 16, 2005, Cabell.

*Primary Examiner*—José A Fortuna
(74) *Attorney, Agent, or Firm*—C. Brant Cook

(57) ABSTRACT

Fibrous structures comprising a tuft. More particularly, the present invention relates to fibrous structures comprising at least two chemically different compositions wherein less than all of the chemically different compositions present in the fibrous structures forms a tuft, and processes for making such fibrous structures are provided.

16 Claims, 7 Drawing Sheets

U.S. PATENT DOCUMENTS 4,614,679 A * 9/1986 Farrington et al. ..... 428/138
5,062,418 A 11/1991 Dyer
5,143,774 A * 9/1992 Cancio et al. ..... 428/169
5,180,620 A * 1/1993 Mende ..... 428/138
5,382,245 A 1/1995 Thompson
5,468,323 A * 11/1995 McNeil ..... 156/209
5,508,080 A 4/1996 Sorimachi et al.
5,518,801 A 5/1996 Chappell
5,536,555 A 7/1996 Zelazoski
5,554,145 A 9/1996 Roe
5,558,655 A 9/1996 Jezzi
5,628,097 A 5/1997 Benson
5,650,214 A 7/1997 Anderson et al.
5,658,639 A 8/1997 Curro
5,700,255 A 12/1997 Curro et al.
5,723,087 A * 3/1998 Chappell et al. ..... 264/284
5,730,738 A 3/1998 McFall et al.
5,792,404 A 8/1998 Cree et al.
5,830,555 A 11/1998 Srinivasan
5,830,558 A * 11/1998 Barnholtz ..... 428/171
5,876,391 A 3/1999 Roe et al.
5,916,661 A 6/1999 Benson
5,919,177 A 7/1999 Georger
5,932,316 A 8/1999 Cree et al.
5,968,029 A 10/1999 Chappell
5,989,688 A 11/1999 Barge
5,990,377 A * 11/1999 Chen et al. ..... 604/381
5,993,432 A 11/1999 Lodge
6,049,024 A 4/2000 Thomas
6,113,723 A * 9/2000 McNeil et al. ..... 156/209
6,120,718 A 9/2000 Kotek et al.
6,150,002 A 11/2000 Varona
6,350,332 B1 2/2002 Thomas
H002042 H * 8/2002 Dobrin et al. ..... 428/152
6,458,447 B1 10/2002 Cabell
6,464,829 B1 * 10/2002 Chen et al. ..... 162/109
6,491,928 B1 12/2002 Smith, III
6,610,391 B2 8/2003 Molee
6,613,028 B1 9/2003 Daley
6,647,549 B2 11/2003 McDevitt et al.
6,716,498 B2 4/2004 Curro et al.
6,721,987 B2 4/2004 McDevitt et al.
6,730,622 B2 5/2004 Curro et al.
6,740,792 B2 5/2004 Waldroup et al.
D494,369 S 8/2004 McDevitt et al.
6,808,791 B2 10/2004 Curro et al.
6,830,800 B2 12/2004 Curro et al.
6,855,220 B2 2/2005 Wildeman
6,863,960 B2 3/2005 Curro et al.
6,869,660 B2 3/2005 Wildeman
6,881,471 B2 * 4/2005 Toussant et al. ..... 428/172
6,911,573 B2 * 6/2005 Chen et al. ..... 604/378
6,977,026 B2 * 12/2005 Liu et al. ..... 162/164.4
7,172,801 B2 * 2/2007 Hoying et al. ..... 428/92
7,220,332 B2 * 5/2007 Curro et al. ..... 156/229
7,374,638 B2 * 5/2008 Horenziak et al. ..... 162/117
7,381,299 B2 * 6/2008 Shannon et al. ..... 162/125
2002/0099347 A1 * 7/2002 Chen et al. ..... 604/369
2002/0103469 A1 * 8/2002 Chen et al. ..... 604/374
2003/0044573 A1 * 3/2003 Rasch et al. ..... 428/131
2003/0050589 A1 3/2003 McDevitt et al.
2003/0077970 A1 4/2003 DeLucia
2003/0097113 A1 5/2003 Molee
2004/0074622 A1 * 4/2004 Liu et al. ..... 162/179
2004/0131820 A1 7/2004 Turner
2004/0157036 A1 8/2004 Provost et al.
2004/0161991 A1 8/2004 Walton et al.
2004/0229008 A1 11/2004 Hoying
2004/0242097 A1 * 12/2004 Hasenoehrl et al. ..... 442/59
2004/0265533 A1 12/2004 Hoying
2004/0265534 A1 12/2004 Curro
2005/0067126 A1 * 3/2005 Horenziak et al. ..... 162/109
2005/0071938 A1 4/2005 McDevitt et al.
2005/0118389 A1 6/2005 Wildeman
2005/0148260 A1 * 7/2005 Kopacz et al. ..... 442/381
2005/0247416 A1 * 11/2005 Forry et al. ..... 162/109
2006/0278356 A1 * 12/2006 Boatman et al. ..... 162/117
2008/0008853 A1 * 1/2008 Hupp et al. ..... 428/85
2008/0102261 A1 * 5/2008 Hupp et al. ..... 428/218
2008/0119807 A1 * 5/2008 Curro et al. ..... 604/367
2008/0154226 A9 * 6/2008 Hammons et al. ..... 604/384
2009/0022960 A1 * 1/2009 Suer et al. ..... 428/194
2009/0022983 A1 * 1/2009 Cabell et al. ..... 428/338
2009/0023839 A1 * 1/2009 Barnholtz et al. ..... 523/222
2009/0025894 A1 * 1/2009 Barnholtz et al. ..... 162/141
2009/0084513 A1 * 4/2009 Barnholtz et al. ..... 162/141

FOREIGN PATENT DOCUMENTS

GB 1 088 991 A 10/1967
GB 1 262 277 A 2/1972
WO WO 95/15138 A1 6/1995
WO WO 97/00656 A1 1/1997
WO WO 9744528 A1 * 11/1997
WO WO 9744529 A1 * 11/1997
WO WO 02/100632 A1 12/2002

* cited by examiner

FIBROUS STRUCTURES COMPRISING A TUFT

CROSS REFERENCE TO RELATED APPLICATIONS

This application claims priority to U.S. Provisional Application Ser. No. 60/581,647 filed Jun. 21, 2004.

FIELD OF THE INVENTION

The present invention relates to fibrous structures comprising a tuft. More particularly, the present invention relates to fibrous structures comprising at least two chemically different compositions wherein less than all of the chemically different compositions present in the fibrous structures forms a tuft, and processes for making such fibrous structures. Even more particularly, the present invention relates to layered fibrous structures and/or fibrous products and processes for making such layered fibrous structures and/or fibrous products. Still even more particularly, the present invention relates to layered fibrous structures and/or fibrous products that comprise a first layer and a second layer, wherein the first layer comprises a first composition and the second layer comprises a second composition, wherein the first and second compositions are chemically different such that the first layer exhibits an extensibility different from the second layer, wherein a portion of one layer protrudes through the other layer such that a surface of the layered fibrous structure and/or fibrous product comprises a tuft, and processes for making such layered fibrous structures and/or fibrous products.

BACKGROUND OF THE INVENTION

Fibrous structures and/or products are known in the art. Examples of such known fibrous structures and/or products include cellulosic fibrous structures wherein the cellulosic fibrous structures consist of chemically different layers.

However, fibrous structures and/or products that comprise two or more chemically different compositions, such as in layers, wherein a tuft is formed in the fibrous structures and/or products by less than all of the chemically different compositions is not known. For example, one layer protrudes through the other layer such that a surface of the layered fibrous structure and/or fibrous product comprises a tuft, is not known.

Accordingly, there is a need for a fibrous structures and/or fibrous products that comprise at least two chemically different compositions wherein less than all of the chemically different compositions forms a tuft in/on the fibrous structure and/or fibrous product, and a process for making such fibrous structures and/or fibrous products.

SUMMARY OF THE INVENTION

The present invention fulfills the needs described above by providing a fibrous structure and/or fibrous product that comprises at least two chemically different compositions wherein a tuft in/on the fibrous structure and/or fibrous product is formed by less than all of the chemically different compositions, and processes for making such fibrous structures and/or fibrous products.

In one example of the present invention, a single-ply fibrous structure comprising at least two chemically different compositions, at least one of which is in the form of a fiber, wherein the fibrous structure comprises a tuft formed by less than all of the chemically different compositions, is provided.

In another example of the present invention, a layered fibrous product comprising a ply comprising at least two layers, wherein one of the at least two layers comprises a fiber, wherein one of the at least two layers protrudes through another of the at least two layers forming a tuft, is provided.

In even another example of the present invention, a layered fibrous product comprising at least two plies, wherein at least one ply comprises at least two layers, wherein one of the at least two layers comprises a fiber, wherein one of the at least two layers protrudes through a second ply, is provided.

In still another example of the present invention, a fibrous product comprising a first layer and a second layer, wherein the first layer comprises a first composition and the second layer comprises a second composition, wherein the first and second compositions are chemically different such that the first layer exhibits an extensibility different from the second layer, wherein a portion of one layer protrudes at least into the other layer such that a surface of the layered fibrous product comprises a tuft, is provided.

In yet another example of the present invention, a process for making a tuft-containing single-ply fibrous structure, the process comprising the steps of:

a) forming a first layer of a first composition;

b) contacting the first layer with a second composition, wherein the second composition is chemically different from the first composition, wherein at least one of the compositions comprises a fiber, such that a single-ply fibrous structure is formed; and c) subjecting the single-ply fibrous structure to a tuft generating process such that a tuft is created in the single-ply fibrous structure, is provided.

In still yet another example of the present invention, a process for making a tuft-containing single-ply fibrous structure, the process comprising the steps of:

a) providing a single-ply fibrous structure comprising at least two chemically different compositions, at least one of which is in the form of a fiber, wherein the fibrous structure comprises a tuft formed by only one of the two chemically different compositions; and b) subjecting the single-ply fibrous structure to a tuft generating process such that a tuft is created in the single-ply fibrous structure, is provided.

In even still another example of the present invention, a process for making a tuft-containing layered fibrous product, the process comprising the steps of:

a) forming a first layer of a first composition;

b) contacting the first layer with a second composition, wherein the second composition is chemically different from the first composition, wherein at least one of the compositions comprises a fiber, such that a layered fibrous product is formed; and c) subjecting the layered fibrous product to a tuft generating process such that a tuft is created in the layered fibrous product, is provided.

In yet still another example of the present invention, a process for making a layered fibrous product, the process comprising the steps of:

a) providing a layered fibrous product comprising a first layer and a second layer; and b) subjecting the layered fibrous product to a tuft generating process such that a portion of the second layer protrudes at least into the first layer such that a tuft is formed on a surface of the layered fibrous product, is provided.

In yet another example of the present invention, a process for making a layered fibrous product, the process comprising the steps of:

a) forming a first layer of a first composition;

b) integrating a second composition with the first layer such that a layered fibrous product comprising the first layer and a second layer comprising the second composition is formed, wherein the second composition is chemically different from the first composition; and c) subjecting the layered fibrous product to a tuft generating process such that a portion of one of the layers protrudes at least into the other layer such that a tuft is formed on a surface of the layered fibrous product, is provided.

In even yet another example of the present invention, a process for making a layered fibrous product, the process comprising the steps of:

a) providing a layered fibrous product comprising a first layer and a second layer, wherein the first layer comprises a first composition and the second layer comprises a second composition, wherein the first and second compositions are chemically different such that the first layer exhibits an extensibility different from the second layer, wherein a portion of one layer protrudes at least into the other layer such that a surface of the layered fibrous product comprises a tuft; and b) subjecting the layered fibrous product to a tuft generating process such that a portion of one layer protrudes at least into the other layer such that a tuft is formed on a surface of the layered fibrous product, is provided.

In still even yet another example of the present invention, a single- or multi-ply sanitary tissue product comprising a fibrous structure and/or fibrous product according to the present invention is provided.

Accordingly, the present invention provides fibrous structures and/or fibrous products and processes for making such fibrous structures and/or fibrous products.

BRIEF DESCRIPTION OF THE DRAWINGS

FIG. 1A is a schematic representation of a fibrous structure in accordance with the present invention;

DETAILED DESCRIPTION OF THE INVENTION

Definitions

Figure 2A:
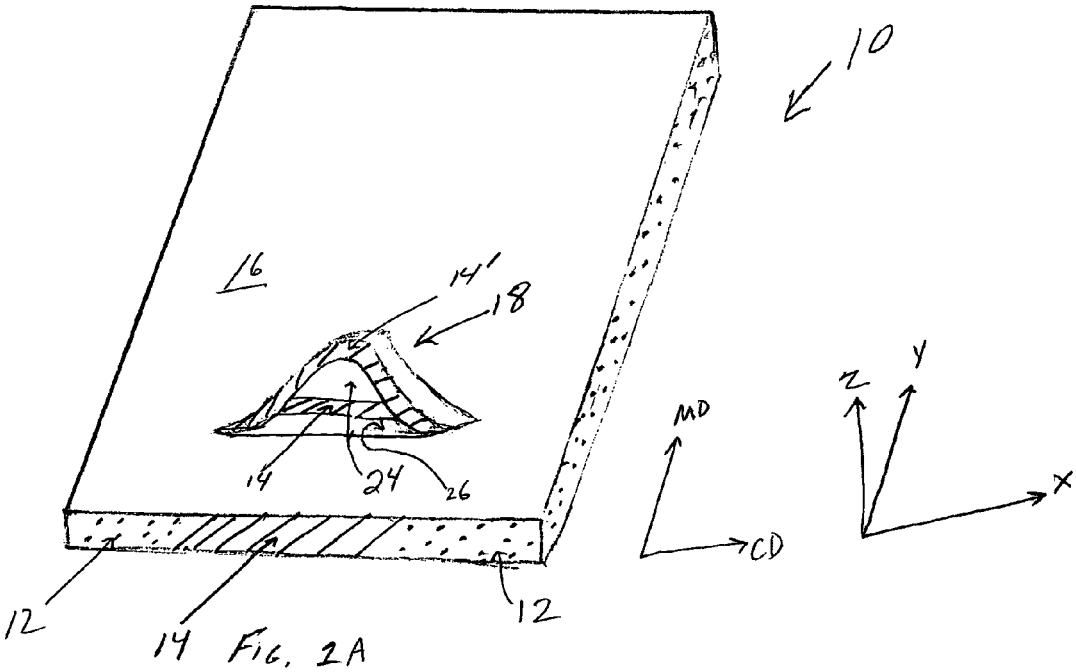
FIG. 2 is a schematic representation of another example of a fibrous product in accordance with the present invention.

"Fiber" as used herein means an elongate physical structure and/or filament having an apparent length greatly exceeding its apparent width, i.e. a length to diameter ratio of at least about 10. More specifically, as used herein, "fiber" refers to web-making fibers. The present invention contemplates the use of a variety of web-making fibers, such as, for example, natural fibers and/or synthetic fibers, especially synthetic thermoplastic polymer fibers, and/or any other suitable fibers, and any combination thereof. Web-making fibers, such as papermaking fibers, useful in the present invention include cellulosic fibers commonly known as wood pulp fibers. Other cellulosic fibrous pulp fibers, such as cotton linters, bagasse, etc., can be utilized and are intended to be within the scope of this invention. Synthetic fibers may include polyolefins, polyesters, polyamides, polyhydroxyalkanoates, polysaccharides, and combinations thereof. More specifically, suitable synthetic fibers may include rayon, polyethylene, polypropylene, polyethylene terephthalate, polybutylene terephthalate, poly(1,4-cyclohexylenedimethylene terephthalate), isophthalic acid copolymers, ethylene glycol copolymers, polycaprolactone, poly(hydroxy ether ester), poly(hydroxyl ether amide), polyesteramide, poly(lactic acid), polyhydroxybutyrate, co-polyethylene terephthalate fibers and mixtures thereof, may also be utilized alone or in combination with other fibers, such as natural cellulosic fibers. The synthetic fibers may comprise thermal bonded synthetic fibers.

Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking. In addition to the above, fibers and/or filaments made from polymers, specifically hydroxyl polymers may be used in the present invention. Nonlimiting examples of suitable hydroxyl polymers include polyvinyl alcohol, starch, starch derivatives, chitosan, chitosan derivatives, cellulose derivatives, gums, arabinans, galactans and mixtures thereof. In addition, protein fibers may also be used in the fibrous structures of the present invention.

The fibers may be of any suitable size, short, long or continuous, as is known in the art. In one example, suitable fibers may have an average fiber length of less than 50 mm and/or from about 25 to about 40 mm and/or from about 2 to about 10 mm and/or from about 3 to about 6 mm.

The fibers may have any average fiber diameter of less than about 50 μm and/or less than about 30 μm and/or less than about 20 μm and/or less than about 10 μm to greater than about 1 nm and/or to greater than about 1 μm.

"Tufted region" as used herein means a region of the fibrous structure and/or fibrous product that comprises one or more tufts. A "tuft" as used herein means a region of the fibrous structure and/or fibrous product that is extended from the fibrous structure and/or fibrous product along the z-axis ("z-axis" as used herein is commonly understood in the art to indicate an "out-of-plane" direction generally orthogonal to the x-y plane as shown in FIG. 1, for example). In one example, a tuft is a continuous loop that extends along the z-axis from the fibrous structure and/or fibrous product. The tuft may define an interior open or substantially open void area that is generally free of fibers. In other words, the tufts of the present invention may exhibit a "tunnel-like" structure, instead of a "tent-like" rib-like element that exhibits continuous side walls as is taught in the prior art. In one example, the tunnel is oriented in the MD of the fibrous structure and/or fibrous product. In another example, as a result of the tuft, a discontinuity is formed in the fibrous structure and/or fibrous product in its x-y plane. A "discontinuity" as used herein is an interruption along the side/surface of the fibrous structure and/or fibrous product opposite the tuft. In other words, a discontinuity is a hole and/or recess and/or void on a side/surface of the fibrous structure and/or fibrous product that is created as a result of the formation of the tuft on the opposite side/surface of the fibrous structure and/or fibrous product. In one example, a deformation in a surface of fibrous structure and/or fibrous product such as a bulge, bump, loop or other protruding structure that extends from a surface of the fibrous structure and/or fibrous product of the present invention.

In one example, the chemically different composition that forms the tuft may be hydrophilic relative to the chemically different composition that is not part of the tuft.

In one example, the tufts of the fibrous structure and/or fibrous product of the present invention may be increase the caliper of the fibrous structure and/or fibrous product by at least about 10% and/or at least about 20% relative to the fibrous structure and/or fibrous product prior to formation of the tufts.

In another example, the tufts may be oriented inward in a multi-ply fibrous product, they may be oriented outward on a multi-ply fibrous product, and they may be oriented such that one ply has the tufts oriented inward and another ply has the tufts oriented outward in/on the multi-ply fibrous product.

In yet another example, the tufted fibrous structure and/or fibrous product of the present invention may be convolutedly wound to form a roll of the fibrous structure and/or fibrous product. Such a roll may exhibit an effective caliper that is greater than the combined caliper of the untufted fibrous structure and/or fibrous product.

In still another example, the tufts of the fibrous structure and/or fibrous product may be phased to embossing, printing and/or perforations on and/or within the fibrous structure and/or fibrous product.

In yet another example, the tufts of the fibrous structure and/or fibrous product may generate enhanced aesthetics through creating differential height/elevation and/or differential texture regions, differential opacity regions, differential color (when tufts have colors (same or varied)), phasing with ink or emboss or other indicia within the fibrous structure and/or fibrous product.

"Non-tufted region" as used herein means a region of the fibrous structure and/or fibrous product that is not extended from the fibrous structure and/or fibrous product along the z-axis.

"Chemically different" as used herein means that the chemical compositions of the fibrous structure and/or fibrous product are not the same. For example, one chemical composition may comprise a cellulosic fiber and another chemical composition may comprise a polyethylene terephthalate fiber. In one example, chemically different as in chemically different compositions means that a web made from one composition exhibits a different Stretch at Peak Load as measured by the Stretch at Peak Load Test Method described herein than another web made from a chemically different composition. The stretch difference may be greater than 5% and/or greater than 10% and/or greater than 25% and/or greater than 40% and/or greater than 50%.

The chemically different compositions of the present invention may be in the forms of "layers" thus forming a "layered" fibrous structure and/or fibrous product.

"Layered" as in "layered fibrous structure" means a physical structure that comprises at least two chemically different compositions. In one example, at least one of the at two chemically different compositions comprises a fiber. The at least two chemically different compositions may be integrated with one another in a unitary physical structure thus forming a single ply or single precursor web prior to subjecting the single ply or precursor web to a deformation generating process. Those of skill in the art of fibrous structures, especially cellulosic fibrous structures such as conventional tissue, understand that a layered fibrous structure (one individual ply) is different from a laminate fibrous product (two or more individual plies). Those of skill in the art also know that a layered fibrous structure can form one or more individual plies of a laminate fibrous structure. Various analytical instruments and/or procedures may be employed to facilitate the determination as to whether a fibrous structure is an individual layered fibrous structure or a combination of two or more individual plies. Such instruments/procedures include SEM and/or light microscopy.

Layered, as defined herein means layered in the Z-direction of the fibrous structure and/or product and also, layered in the X-Y direction of the fibrous structure and/or product. In other words, layered as used herein means that the fibrous structure and/or fibrous product of the present invention comprises two or more regions that are chemically different from one another.

A layered fibrous structure of the present invention can be produced by bringing the two chemically different compositions together to form a unitary physical structure and/or integrating one of the compositions in a non-ply form with the other composition, when the other composition is already in the form of a physical structure, such as a ply. One example of this is meltblowing and/or spunbonding and/or otherwise depositing a thermoplastic polymer onto an existing cellulosic web. The thermoplastic polymer, at the time of the deposition step is not in the form of a precursor web, A layered fibrous structure is not a multi-ply fibrous product wherein two, separate discrete pre-formed plies or webs are brought into contact with one another via bonding, or other means of attachment. This does not exclude an example wherein the layered fibrous structure of the present invention is a ply that is combined with another ply of a material.

"Fibrous product" and/or "sanitary tissue product" as used herein includes but is not limited to a wiping implement for post-urinary and post-bowel movement cleaning (toilet tissue), for otorhinolaryngological discharges (facial tissue), and multi-functional absorbent and cleaning uses (absorbent towels). A fibrous product comprises a fibrous structure.

"Integrated" as used herein means directly bound to a chemically different composition, which can be in the form of a layer, of a fibrous structure and/or fibrous product. In other words, no discrete adhesive or other binding agent is used to bind a first chemically different composition to a second chemically different composition within the fibrous structure and/or fibrous product.

"Extensibility" as in "extensibility of a chemically different composition, which may be in the form of a layer" is determined according to the Stretch at Peak Load Test Method described herein.

"Integral" as used herein means a portion of the fibrous structure and/or fibrous product that was present in the fibrous structure and/or fibrous product upon original formation of the fibrous structure and/or fibrous product. In other words, an "integral" portion is not a portion of a fibrous structure and/or fibrous product that was added subsequent to the original formation of the fibrous structure and/or fibrous product. For example, an "integral" portion of a fibrous structure and/or fibrous product is to be distinguished from a portion of the fibrous structure and/or fibrous product, such as fibers, introduced to or added to the originally formed fibrous structure and/or fibrous product for the purpose of making tufts, as is commonly done in conventional carpet making.

"Ply" or "Plies" as used herein means a single fibrous structure and/or fibrous product optionally to be disposed in a substantially contiguous, face-to-face relationship with other plies, forming a multi-ply web product. It is also contemplated that a single fibrous structure and/or fibrous product can effectively form two "plies" or multiple "plies", for example, by being folded on itself. Ply or plies can also exist as films or other polymeric structures.

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a layered fibrous product and/or film according to the present invention on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$) is measured. The basis weight ($g/m^2$) is calculated by dividing the average weight (g) by the average area of the samples ($m^2$).

"Caliper" or "Sheet Caliper" as used herein means the macroscopic thickness of a single-ply fibrous structure and/or fibrous product, web product or film according to the present invention. Caliper of a fibrous structure and/or fibrous product, web product or film according to the present invention is determined by cutting a sample of the fibrous structure and/or fibrous product, web product or film such that it is larger in size than a load foot loading surface where the load foot loading surface has a circular surface area of about 3.14 $in^2$. The sample is confined between a horizontal flat surface and the load foot loading surface. The load foot loading surface applies a confining pressure to the sample of 15.5 $g/cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in millimeters.

In one example, the single-ply fibrous structure and/or fibrous product and/or sanitary tissue product according to the present invention exhibits a sheet caliper of at least about 0.508 mm (20 mils) and/or at least about 0.762 mm (30 mils) and/or at least about 1.524 mm (60 mils).

"Effective Caliper" as used herein means the radial thickness a layer of fibrous structure and/or sanitary tissue product occupies within a convolutely wound roll of such fibrous structure and/or sanitary tissue product. In order to facilitate the determination of effective caliper, an Effective Caliper Test Method is described herein. The effective caliper of a fibrous structure and/or sanitary tissue product can differ from the sheet caliper of the fibrous structure and/or sanitary tissue product due to winding tension, nesting of deformations, etc.

"Apparent Density" or "Density" as used herein means the basis weight of a sample divided by the caliper with appropriate conversions incorporated therein. Apparent density used herein has the units $g/cm^3$.

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Plasticity" as used herein means at least that a material within the fibrous structure and/or fibrous product exhibits a capability of being shaped, molded and/or formed.

"Peak Stretch" as used herein is defined by the following formula:

$$\frac{\text{Length of Web } structure_{WL} - \text{Length of Web } structure_I \times 100\%}{\text{Length of Web } structure_I}$$

wherein:

Length of Web $structure_{WL}$ is the length of the web structure at peak load;

Length of Web $structure_I$ is the initial length of the web structure prior to stretching.

The Strength of the Web structure is determined by measuring a web structure's Total Dry Tensile Strength (both MD and CD) or "TDT" using ASTM Standard D828. TDT or Stretch is measured by providing one (1) inch by five (5) inch (2.5 cm×12.7 cm) strips of the web structure in need of testing. Each strip is placed on an electronic tensile tester Model 1122 commercially available from Instron Corp., Canton, Mass. The crosshead speed of the tensile tester is 4.0 inches per minute (about 10.16 cm/minute) and the gauge length is 4.0 inch (about 10.16 cm). The tensile tester calculates the stretch at Peak Load and the stretch at Failure Load. Basically, the tensile tester calculates the stretches via the formulae described above. The Stretch at Peak Load, as used herein, is the average of the Stretch at Peak Load for MD and CD. The Stretch at Failure Load, as used herein, is the average of the Stretch at Failure Load for MD and CD.

"Machine direction" (or MD) is the direction parallel to the flow of the fibrous structure and/or fibrous product and/or precursor fibrous structure being made through the manufacturing equipment.

"Cross machine direction" (or CD) is the direction perpendicular to the machine direction and parallel to the general plane of the fibrous structure and/or fibrous product and/or layered fibrous structure.

"Absorbent" and "absorbency" as used herein means the characteristic of the fibrous structure which allows it to take up and retain fluids, particularly water and aqueous solutions and suspensions. In evaluating the absorbency of paper, not only is the absolute quantity of fluid a given amount of paper will hold significant, but the rate at which the paper will absorb the fluid is also. Absorbency is measured here in by the Horizontal Full Sheet (HFS) test method described in the Test Methods section herein. In one example, the fibrous structures and/or sanitary tissue products according to the present invention exhibit an HFS absorbency of greater than about 5 g/g and/or greater than about 8 g/g and/or greater than about 10 g/g up to about 100 g/g. In another nonlimiting example, the fibrous structures and/or sanitary tissue products according to the present invention exhibit an HFS absorbency of from about 12 g/g to about 30 g/g.

Precursor Fibrous Structure

The fibrous structure and/or fibrous product of the present invention may be made from any suitable precursor layered fibrous structure known to those skilled in the art.

Nonlimiting examples of suitable precursor fibrous structures include a precursor fibrous structure upon which a thermoplastic polymer has been deposited; a precursor thermoplastic polymer substrate upon which fibers have been deposited; a precursor fibrous structure in which a thermoplastic polymer has been intermingled with the fibers of the fibrous structure Conventionally pressed tissue paper and methods for making such paper are well known in the art. Such paper is typically made by depositing a papermaking furnish on a foraminous forming wire, often referred to in the art as a Fourdrinier wire. Once the furnish is deposited on the forming wire, it is referred to as a web. The web is dewatered by pressing the web and drying at elevated temperature. The particular techniques and typical equipment for making webs according to the process just described are well known to those skilled in the art. In a typical process, a low consistency pulp furnish is provided from a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering and further dried by pressing operations wherein the web is subjected to pressure developed by opposing mechanical members, for example, cylindrical rolls. The dewatered web is then further pressed and dried by a steam drum apparatus known in the art as a Yankee dryer. Pressure can be developed at the Yankee dryer by mechanical means such as an opposing cylindrical drum pressing against the web. Multiple Yankee dryer drums can be employed, whereby additional pressing is optionally incurred between the drums. The tissue paper structures that are formed are referred to hereafter as conventional, pressed, tissue paper structures. Such sheets are considered to be compacted since the entire web is subjected to substantial mechanical compressional forces while the fibers are moist and are then dried while in a compressed state.

The precursor fibrous structure may be made with a fibrous furnish that produces a single layer embryonic fibrous web or a fibrous furnish that produces a multi-layer embryonic fibrous web.

The precursor fibrous structures of the present invention and/or fibrous structure and/or fibrous products comprising such precursor fibrous structures may have a basis weight of from about 12 g/m$^2$ to about 120 g/m$^2$ and/or from about 14 g/m$^2$ to about 80 g/m$^2$ and/or from about 20 g/m$^2$ to about 60 g/m$^2$.

The precursor fibrous structures of the present invention and/or fibrous structure and/or fibrous products comprising such precursor fibrous structures may have a total dry tensile of greater than about 150 g/in and/or from about 200 g/in to about 20,000 g/in and/or from about 250 g/in to about 10,000 g/in.

The precursor fibrous structures according to the present invention may comprise any fibrous structure type known in the industry, such as air laid fibrous structures and/or wet laid fibrous structures. Nonlimiting examples of suitable fibrous structure types and methods for making same are described in U.S. Pat. Nos. 4,191,609 issued Mar. 4, 1980 to Trokhan; 4,300,981 issued to Carstens on Nov. 17, 1981; 4,191,609 issued to Trokhan on Mar. 4, 1980; 4,514,345 issued to Johnson et al. on Apr. 30, 1985; 4,528,239 issued to Trokhan on Jul. 9, 1985; 4,529,480 issued to Trokhan on Jul. 16, 1985; 4,637,859 issued to Trokhan on Jan. 20, 1987; 5,245,025 issued to Trokhan et al. on Sep. 14, 1993; 5,275,700 issued to Trokhan on Jan. 4, 1994; 5,328,565 issued to Rasch et al. on Jul. 12, 1994; 5,334,289 issued to Trokhan et al. on Aug. 2, 1994; 5,364,504 issued to Smurkowski et al. on Nov. 15, 1995; 5,527,428 issued to Trokhan et al. on Jun. 18, 1996; 5,556,509 issued to Trokhan et al. on Sep. 17, 1996; 5,628,876 issued to Ayers et al. on May 13, 1997; 5,629,052 issued to Trokhan et al. on May 13, 1997; 5,637,194 issued to Ampulski et al. on Jun. 10, 1997; 5,411,636 issued to Hermans et al. on May 2, 1995; EP 677612 published in the name of Wendt et al. on Oct. 18, 1995.

The precursor fibrous structures in accordance with the present invention may comprise a fibrous structure, known in the art, selected from the group consisting of: through-air-dried fibrous structures, differential density fibrous structures, differential basis weight fibrous structures, wet laid fibrous structures, air laid fibrous structures (examples of which are described in U.S. Pat. Nos. 3,949,035 and 3,825,381), conventional dried fibrous structures, creped or uncreped fibrous structures, patterned-densified or non-patterned-densified fibrous structures, compacted or uncompacted fibrous structures, nonwoven fibrous structures comprising synthetic or multicomponent fibers, homogeneous or multilayered fibrous structures, double re-creped fibrous structures, uncreped fibrous structures, co-form fibrous structures (examples of which are described in U.S. Pat. No. 4,100,324) and mixtures thereof.

In one example, the air laid fibrous structure is selected from the group consisting of thermal bonded air laid (TBAL) fibrous structures, latex bonded air laid (LBAL) fibrous structures and mixed bonded air laid (MBAL) fibrous structures.

The precursor fibrous structures may exhibit a substantially uniform density or may exhibit differential density regions, in other words regions of high density compared to other regions within the patterned fibrous structure. Typically, when a fibrous structure is not pressed against a cylindrical dryer, such as a Yankee dryer, while the fibrous structure is still wet and supported by a through-air-drying fabric or by another fabric or when an air laid fibrous structure is not spot bonded, the fibrous structure typically exhibits a substantially uniform density.

In one example, the precursor fibrous structure of the present invention comprises about 100% wood pulp fibers.

The precursor fibrous structure may be foreshortened by creping and/or by wet microcontraction and/or by rush transferring. Alternatively, the precursor fibrous structure may not be foreshortened.

The precursor fibrous structure may be pattern densified. A pattern densified fibrous structure is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. A preferred method of making a pattern densified fibrous structure and devices used therein are described in U.S. Pat. Nos. 4,529,480 and 4,528,239.

The precursor fibrous structure may be uncompacted, non pattern-densified.

The precursor fibrous structure may be of a homogenous or multilayered construction.

The precursor fibrous structure may be made with a fibrous furnish that produces a single layer embryonic fibrous web or a fibrous furnish that produces a multi-layer embryonic fibrous web.

The precursor fibrous structure and/or fibrous product may contain any ingredient known to those of skill in the art. Nonlimiting examples of such ingredients include permanent wet strength agents, temporary wet strength agents, debonding agents, dry strength agents, softening agents, bonding agents, colorants, antimicrobials, other hydrophilic or hydrophobic materials and the like.

Fibrous Structure and/or Fibrous Product

The fibrous structure and/or fibrous product of the present invention comprises at least two chemically different compositions. The chemically different compositions may exhibit different extensibility properties as measured according to the Stretch at Peak Load Test Method described herein. The chemically different compositions of the fibrous structure and/or fibrous product may be present in the same x-y planar layer and/or in two or more different layers within the fibrous product.

The compositions of the layers may comprise synthetic and/or natural materials.

Nonlimiting examples of suitable synthetic materials include polyethylene terephthalate, polyethylene terephthalate/co-polyethylene terephthalate, polyethylene, polypropylene, polyesters, polyolefins, polyamides, polyacrylates, polyhydroxyalkanoates, polylactic acids and mixtures thereof.

Nonlimiting examples of suitable natural materials include keratin, cellulose, cellulose derivatives, starch, starch derivatives, chitosan, chitosan derivatives, guar, arabinans, galactans, proteins and various other polysaccharides and mixtures thereof.

The synthetic materials may be in the form of fibers, films and/or droplets.

The natural materials may be in the form of fibers, films and/or droplets.

In one example, a fibrous structure and/or fibrous product of the present invention comprises a layer comprising a synthetic material in fiber form such as a melt blown fiber, and another layer comprising a natural material in fiber form, such as a cellulosic fiber.

So long as the fibrous structure and/or fibrous product of the present invention comprises at least two chemically different compositions, the fibrous structure and/or fibrous product may comprise natural and/or synthetic fibers, films and/or droplets.

In one example, a fibrous structure and/or fibrous product of the present invention comprises two layers, each layer comprising a natural fiber.

In another example, a fibrous structure and/or fibrous product of the present invention comprises three layers, each layer comprising a natural fiber.

In even another example, a fibrous structure and/or fibrous product of the present invention comprises a layer comprising a natural fiber and a layer comprising a synthetic fiber.

In yet another example, a fibrous structure and/or fibrous product of the present invention comprises a layer comprising a natural fiber and a layer comprising a synthetic film.

In still another example, a fibrous structure and/or fibrous product of the present invention comprises two layers, each layer comprising a synthetic fiber.

In even still another example, a fibrous structure and/or fibrous product of the present invention comprises a layer comprising a synthetic fiber and a layer comprising a synthetic film.

In yet still another example, a fibrous structure and/or fibrous product of the present invention wherein at least one of the at least two chemically different compositions comprises a thermoplastic polymer. The thermoplastic polymer may be in a form selected from the group consisting of: films, fibers, continuous scrim (a continuous network of thermoplastic polymer), discontinuous scrim (discrete regions bordered by the thermoplastic polymer), semi-continuous scrim (non-intersecting lines of the thermoplastic polymer), discrete areas (dots of the thermoplastic polymer) and mixtures thereof.

The fibrous structure and/or fibrous product and/or precursor layered fibrous structure may be made by any suitable means.

A nonlimiting example of a process for making a fibrous structure and/or fibrous product of the present invention includes forming a fibrous structure (layered or not) and then depositing on the surface thereof one or more fibers. For example, a cellulosic fibrous structure may be formed by any suitable process, such as wet laid, air laid, etc., then a meltblown polymer, such as polyethylene terephthalate and/or polyethylene terephthalate/co-polyethylene terephthalate can be applied, in the form of meltblown fibers, to the surface of the cellulosic fibrous structure and then subjecting to a tuft generating process to produce a fibrous structure and/or fibrous product in accordance with the present invention. Such a process may be run at any suitable speed. In one example, the process can be run at 900 ft/min.

Another nonlimiting example of a process for making a fibrous structure and/or fibrous product of the present invention includes forming a fibrous structure (layered or not) and then depositing on the surface thereof a film. For example, a cellulosic fibrous structure may be formed by any suitable process, such as wet laid, air laid, etc., then a meltblown polymer, in film form, can be applied to the surface of the cellulosic fibrous structure and then subjecting it to a tuft generating process to produce a fibrous structure and/or fibrous product in accordance with the present invention.

The layers may be formed at any stage of the papermaking and/or converting process. For example, the layers may be formed at the wet end of the papermaking process and/or at the dry end of the papermaking process and/or at the converting line.

In one example, the fibrous structure and/or fibrous product may comprise 100% biodegradable materials.

The fibrous structure and/or fibrous products of the present invention are useful in paper, especially sanitary tissue paper products in general, including but not limited to conventionally felt-pressed tissue paper; high bulk pattern densified tissue paper; and high bulk, uncompacted tissue paper. The fibrous structure and/or fibrous products can be of a homogenous or multi-layered construction; and fibrous structure and/or fibrous products made therefrom can be of a single-ply or multi-ply construction. The fibrous structure and/or fibrous product may have a basis weight of between about 10 g/m$^2$ to about 200 g/m$^2$, and a density of from about 0.6 g/cc or less.

The fibrous structure and/or fibrous product of the present invention may comprise two or more layers. For example, a pre-formed cellulosic fibrous structure may comprise two or more layers, each layer comprising a cellulosic fiber. One layer may comprise a hardwood fiber, another layer may comprise a softwood fiber. This is very common in conventional tissue/towel papermaking processes. However, if both layers are identical except for the type of cellulosic fiber, then the layers would not be chemically different as defined hereinabove. The layered fibrous structure of the present invention is especially focused upon the interface between two chemically different layers, regardless of how many total layers are present in the layered fibrous structure.

As shown in FIG. 1A, a fibrous structure and/or fibrous product 10 of the present invention may comprise a first layer 12 and a second layer 14 and a surface of the fibrous product 16, wherein the first layer 12 comprises a first composition and the second layer 14 comprises a second composition, wherein the first and second compositions are chemically different such that the first layer 12 exhibits an extensibility different from the second layer 14, wherein a portion of one layer, such as a portion of the second layer 14', less than all of the chemically different compositions forms a tuft 18 on the surface of the fibrous product 16. For illustration purposes, only a single tuft is shown. However, the present invention encompasses fibrous structures and/or fibrous products that comprise a surface that comprises one or more tufts.

Figure 1B:
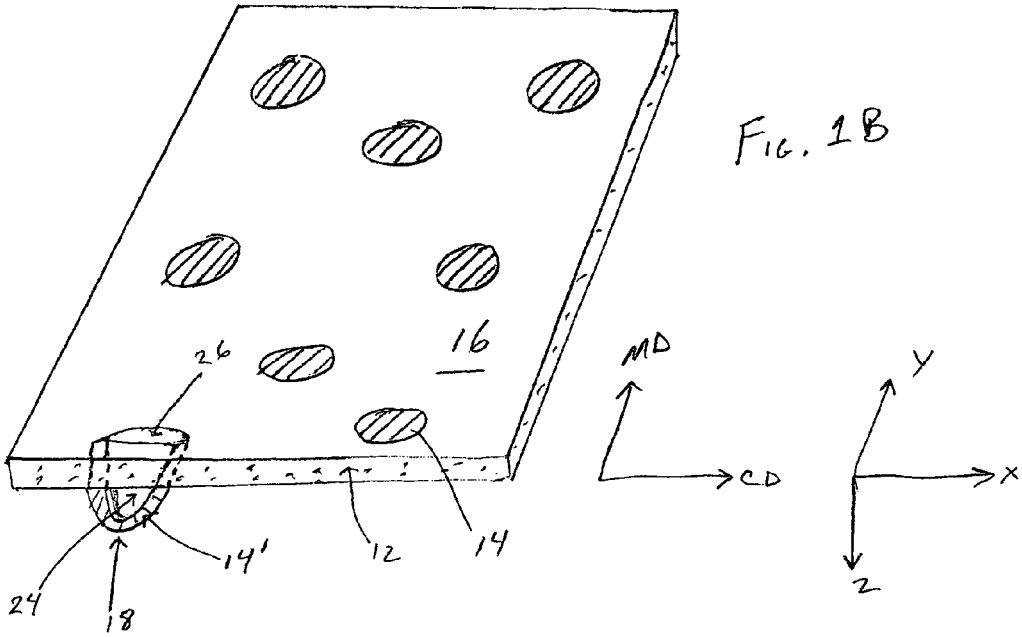
FIG. 1B is a schematic representation of another example of a fibrous structure in accordance with the present invention.

As shown in FIG. 1B, a fibrous structure and/or fibrous product 10 of the present invention may comprise a first layer 12 and a second layer 14, wherein the second layer 14 is present on the surface 16 of the fibrous structure and/or fibrous product 10 in the form of discrete regions. The first layer 12 comprises a first composition and the second layer 14 comprises a second composition, wherein the first and second compositions are chemically different such that the first layer 12 exhibits an extensibility different from the second layer 14, wherein a portion of one layer, such as a portion of the second layer 14', less than all of the chemically different compositions forms a tuft 18 on the surface of the fibrous product 16. For illustration purposes, only a single tuft is shown. However, the present invention encompasses fibrous structures and/or fibrous products that comprise a surface that comprises one or more tufts.

Figure 2:
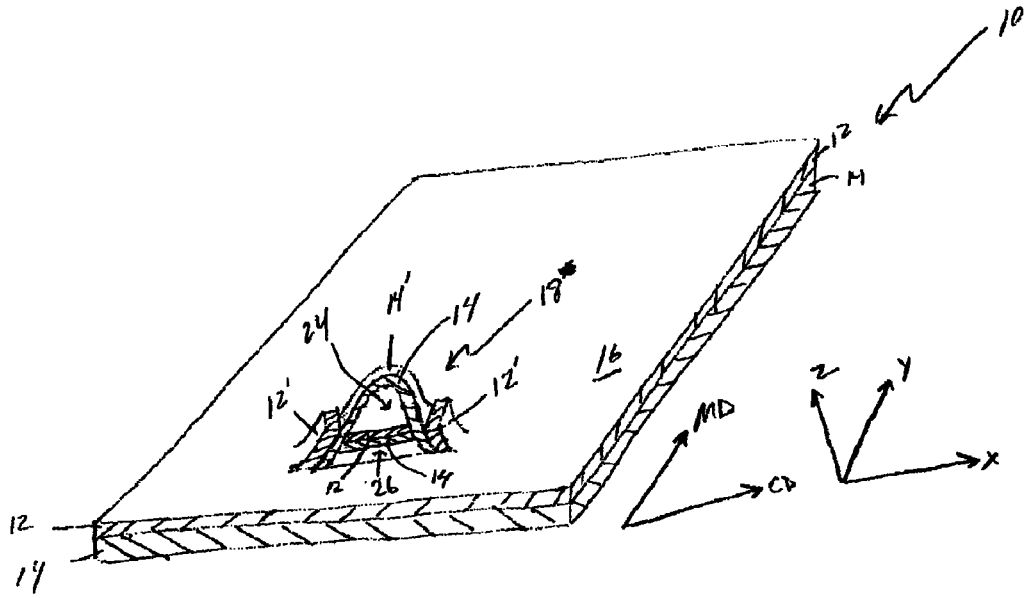

As shown in FIG. 2, a fibrous structure and/or fibrous product 10' of the present invention may comprise a first layer 12 and a second layer 14, wherein the first layer 12 comprises a first composition and the second layer 14 comprises a second composition, wherein the first and second compositions are chemically different such that the first layer 12 exhibits an extensibility different from the second layer 14, wherein a portion of one layer, such as a portion of the second layer 14' protrudes through the other layer, such as the first layer 12 such that flaps 12' are formed and such that a surface of the fibrous structure and/or fibrous product 16 comprises a tuft 18. For illustration purposes, only a single tuft is shown. However, the present invention encompasses layered fibrous structures that comprise a surface that comprises one or more tufts.

Figure 3:
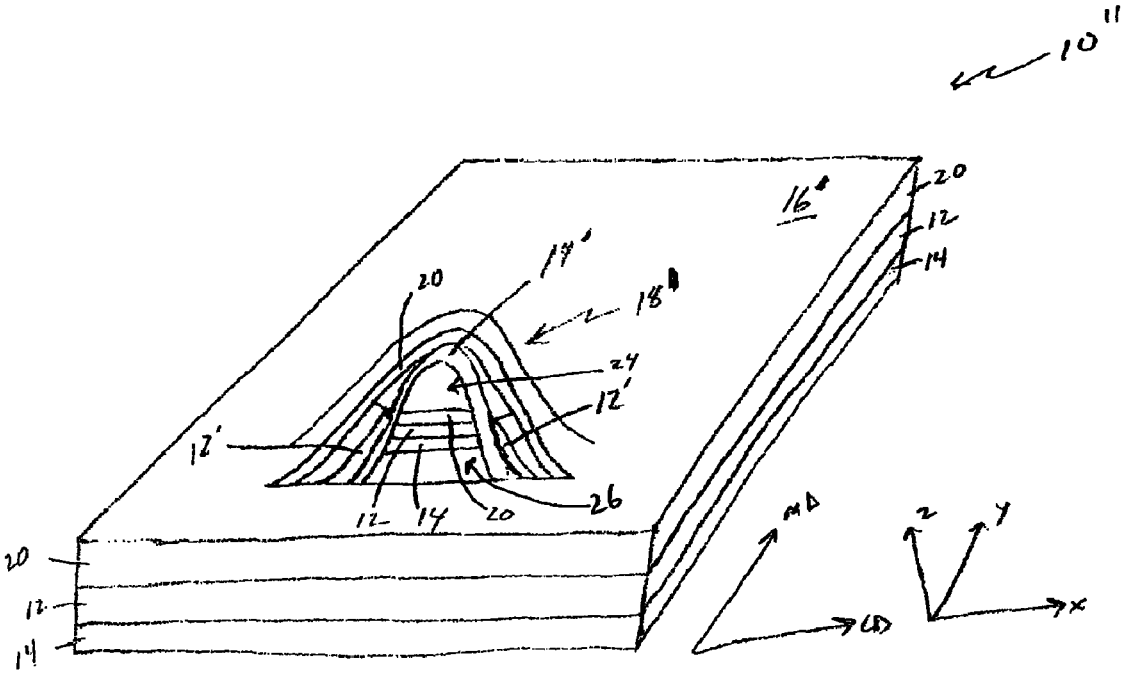
FIG. 3 is a schematic representation of another example of a fibrous product in accordance with the present invention.

As shown in FIG. 3, a fibrous structure and/or fibrous product 10" of the present invention may comprise a first layer 12, a second layer 14 and a third layer 20, wherein the first layer 12 comprises a first composition and the second layer 14 comprises a second composition, wherein the first and second compositions are chemically different such that the first layer 12 exhibits an extensibility different from the second layer 14, wherein a portion of one layer, such as a portion of the second layer 14' protrudes through at least one other layer, such as the first layer 12, such that flaps 12' are formed and such that a surface of the fibrous structure and/or fibrous product 16 comprises a tuft 18'. For illustration purposes, only a single tuft is shown. However, the present invention encompasses fibrous structures and/or fibrous products that comprise a surface that comprises one or more tufts.

Figure 4:
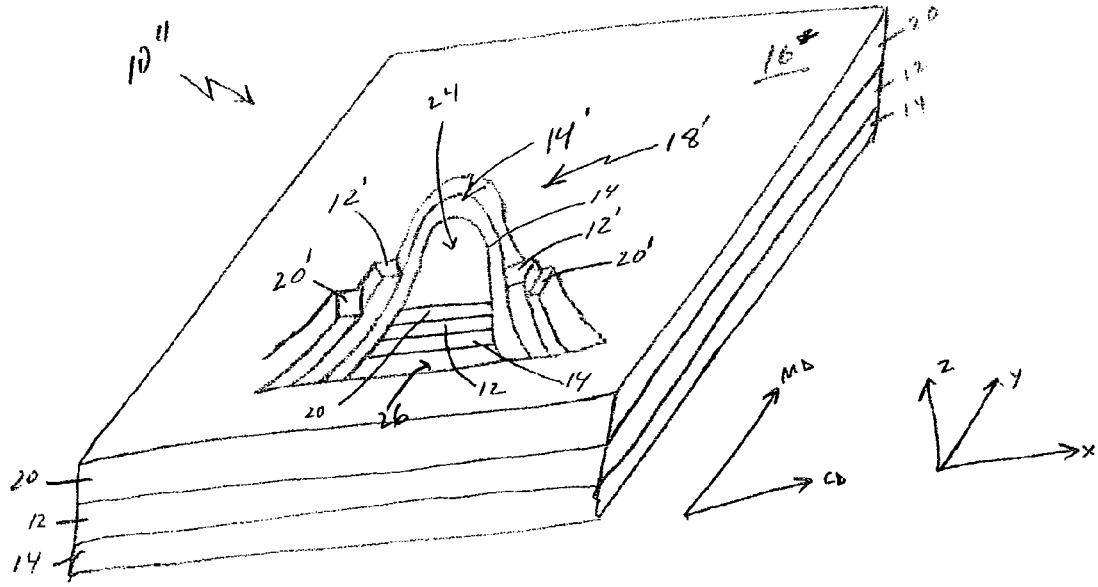
FIG. 4 is a schematic representation of another example of a fibrous product in accordance with the present invention.

As shown in FIG. 4, a fibrous structure and/or fibrous product 10" of the present invention may comprise a first layer 12, a second layer 14 and a third layer 20, wherein the first layer 12 comprises a first composition and the second layer 14 comprises a second composition, wherein the first and second compositions are chemically different such that the first layer 12 exhibits an extensibility different from the second layer 14, wherein a portion of one layer, such as a portion of the second layer 14' protrudes through at least one other layer (in the present case, both other layers), such as the first layer 12 such that flaps 12' are formed and the third layer 20 such that flaps 20' and such that a surface of the fibrous structure and/or fibrous product 16 comprises a tuft 18. For illustration purposes, only a single tuft is shown. However, the present invention encompasses fibrous structures and/or fibrous products that comprise a surface that comprises one or more tufts.

The tufts illustrated in FIGS. 1-4 may comprise no fibers, one fiber or a plurality of fibers.

As seen in FIGS. 1-4, upon tuft formation, an open void area 24 is formed within the tuft 18 and a discontinuity 26 is formed on the non-tufted surface of the fibrous structure and/or fibrous product 10.

The tuft of the fibrous structure and/or fibrous product may comprise a fiber or a portion of a fiber and/or a film or portion of a film.

The tuft of the fibrous structure and/or fibrous products of the present invention may comprise any suitable material so long as the material of the tuft exhibits sufficient stretch to be deformed in the tuft generating process. In other words, the material of the tuft must have a stretch at peak load that is sufficient to permit deformation of the material into the tuft during the tuft generating process. In one example, the material exhibits a stretch at peak load before formation of the tuft of at least about 1% and/or at least about 3% and/or at least about 5%. The material after tuft formation may also exhibit such a stretch or it may not.

In another example, the fibrous structure and/or fibrous product of the present invention comprises a tufted region and a non-tufted region, wherein the tufted region comprises a tuft and wherein the tufted region is integral with but extends from the non-tufted region.

In yet another example, the fibrous structure and/or fibrous product of the present invention comprises a first region and at least one discrete integral second region, the second region having at least one portion being a discontinuity and at least another portion being a deformation comprising at least one tuft integral with but extending from the first region.

In even yet another example, the fibrous structure and/or fibrous product comprises a first region and at least one discrete integral second region, the second region having at least one portion being a discontinuity exhibiting a linear orientation and defining a longitudinal axis (L) and at least another portion being a deformation comprising at least one tufted fiber integral with but extending from the first region.

In even still another example, a multi-ply fibrous product comprises a first web ply and a second web ply, at least one of the first web ply and second web ply comprises a fibrous product in accordance with the present invention.

The fibrous structure and/or fibrous product of the present invention may be combined with an additional fibrous structure and/or fibrous product, the same or different from the fibrous structure and/or fibrous product of the present invention. Tufts present in the fibrous structure and/or fibrous product of the present invention may protrude at least into the additional fibrous structure and/or fibrous product. In addition, the tufts present in the fibrous structure and/or fibrous product of the present invention may protrude through the additional fibrous structure and/or fibrous product as a result of the addition fibrous structure and/or fibrous product breaking at the point of the tuft.

The additional fibrous structure and/or fibrous product may be combined with the fibrous structure and/or fibrous product of the present invention by any suitable means. The fibrous structure and/or fibrous products may be combined before or after tufts are present in the fibrous structure and/or fibrous product of the present invention.

The fibrous structure and/or fibrous product of the present invention and the additional fibrous structure and/or fibrous product may exhibit different stretch properties at peak load. For example the fibrous structure and/or fibrous product of the present invention may exhibit a stretch at peak load that is less than the stretch at peak load of the additional fibrous structure and/or fibrous product.

In another example, a portion of the fibrous structure and/or fibrous product of the present invention may exhibit a stretch at peak load that is less than the stretch at peak load of the additional web or portions of the additional web. The stretch at peak load of the fibrous structure and/or fibrous product of the present invention or portions thereof may be influenced, especially immediately before and/or during being subjected to a tuft generating process such that the stretch at peak load of the fibrous structure and/or fibrous product of the present invention or portions thereof is greater than the stretch at peak load of the additional fibrous structure and/or fibrous product.

In other examples, the fibrous structure and/or fibrous product of the present invention or portions thereof may exhibit a greater stretch at peak load than the additional fibrous structure and/or fibrous product or portions thereof.

The fibrous structure and/or fibrous products of the present invention may be formed by any suitable process known in the art.

Tuft Generating Process

Figure 5:
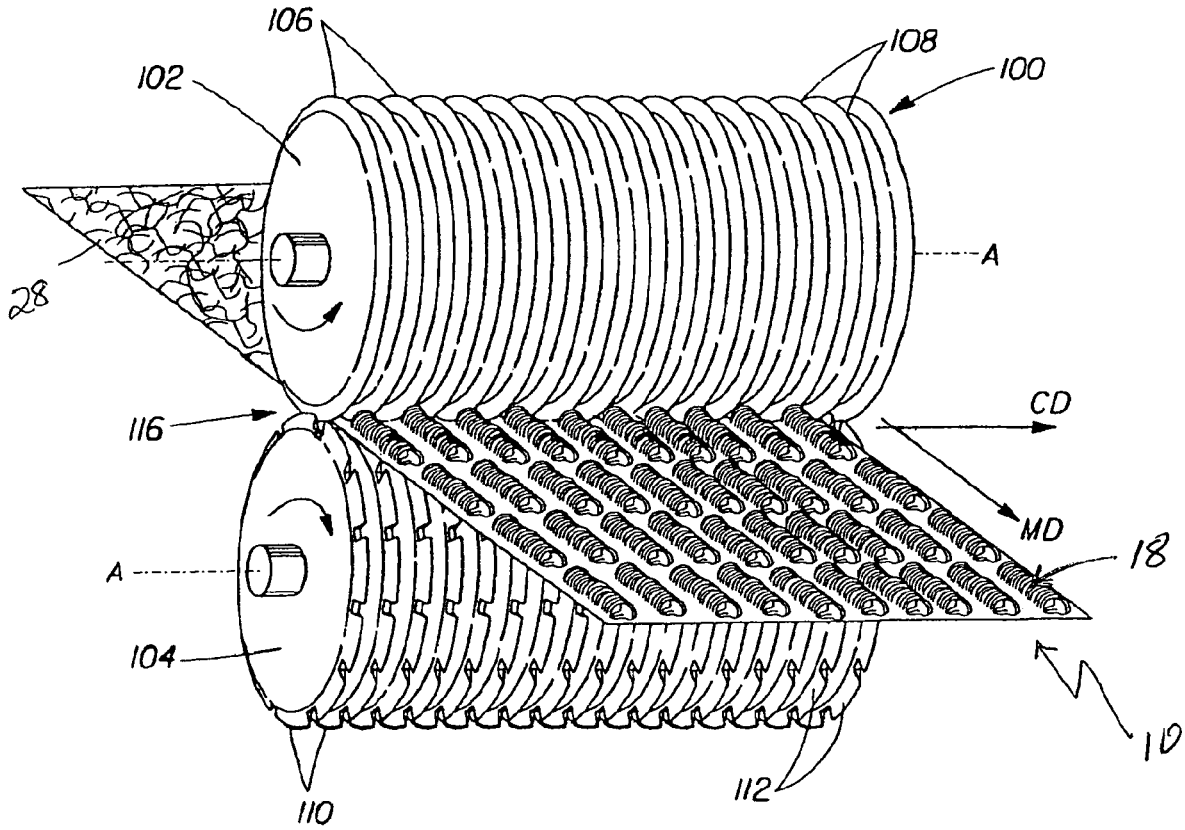
FIG. 5 is a perspective view of an apparatus for forming a fibrous structure of the present invention.

Referring to FIG. 5, there is shown a nonlimiting example of an apparatus and method for making a fibrous structure and/or fibrous product of the present invention. The apparatus 100 comprises a pair of intermeshing rolls 102 and 104, each rotating about an axis A, the axes A being parallel in the same plane. Roll 102 comprises a plurality of ridges 106 and corresponding grooves 108 which extend unbroken about the entire circumference of roll 102. Roll 104 is similar to roll 102, but rather than having ridges that extend unbroken about the entire circumference, roll 104 comprises a plurality of rows of circumferentially-extending ridges that have been modified to be rows of circumferentially-spaced teeth 110 that extend in spaced relationship about at least a portion of roll 104. The individual rows of teeth 110 of roll 104 are separated by corresponding grooves 112. In operation, rolls 102 and 104 intermesh such that the ridges 106 of roll 102 extend into the grooves 112 of roll 104 and the teeth 110 of roll 104 extend into the grooves 108 of roll 102. The intermeshing is shown in greater detail in the cross sectional representation of FIG. 6, discussed below.

In FIG. 5, the apparatus 100 is shown having one patterned roll, e.g., roll 104, and one non-patterned grooved roll 102. However, in certain examples it may be desirable to use two patterned rolls 104 having either the same or differing patterns, in the same or different corresponding regions of the respective rolls. Such an apparatus can produce fibrous structure and/or fibrous products with tufts protruding from both sides of the fibrous structure and/or fibrous product.

The process of the present invention is similar in many respects to a process as described in U.S. Pat. No. 5,518,801 entitled "Web Materials Exhibiting Elastic-Like Behavior" and referred to in subsequent patent literature as "SELF" webs, which stands for "Structural Elastic-like Film". However, there are significant differences between the apparatus of the present invention and the apparatus disclosed in the above-identified '801 patent. These differences account for the novel features of the web of the present invention. As described below, the teeth 110 of roll 104 have a specific geometry associated with the leading and trailing edges that permit the teeth, e.g., teeth 110, to essentially "punch" through the precursor fibrous structure 28 as opposed to, in essence, emboss the web. The difference in the apparatus 100 of the present invention results in a fundamentally different fibrous structure and/or fibrous product.

Precursor fibrous structure 28 is provided either directly from a web making process or indirectly from a supply roll (neither shown) and moved in the machine direction to the nip 116 of counter-rotating intermeshing rolls 102 and 104. Precursor fibrous structure 28 can be any suitable fibrous structure and/or fibrous product that exhibits or is capable of exhibiting sufficient stretch at peak load to permit formation of tufts in the fibrous structure and/or fibrous product. Precursor fibrous structure 28 can be plasticized by any means known in the art, such as by subjecting the precursor web to a humid environment. Furthermore, precursor fibrous structure 28 can be a nonwoven web made by known processes, such as meltblown, spunbond, rotary spinning and carded. As precursor fibrous structure 28 goes through the nip 116 the teeth 110 of roll 104 enter grooves 108 of roll 102 and simultaneously urge fibers out of the plane of plane of precursor fibrous structure 28 to form tufts 18 and discontinuities 26, not shown in FIG. 5. In effect, teeth 110 "push" or "punch" through precursor fibrous structure 28. As the tip of teeth 110 push through precursor fibrous structure 28 the portions of fibers that are oriented predominantly in the CD and across teeth 110 are urged by the teeth 110 out of the plane of precursor fibrous structure 28 and are stretched, pulled, and/or plastically deformed in the z-axis, resulting in formation of the tuft 18. Fibers that are predominantly oriented generally parallel to the longitudinal axis L, i.e., in the machine direction of precursor fibrous structure 28 as shown in FIG. 10, are simply spread apart by teeth 110 and remain substantially in the non-tufted region of the fibrous structure and/or fibrous product 10. Although, as discussed more fully below, it has been found that the rate of formation of tufts 18 affects fiber orientation, in general, and at least at low rates of formation, it can be understood why the tufted fibers can exhibit the unique fiber orientation which is a high percentage of fibers having a significant or major vector component parallel to the transverse axis T of tuft 18, as discussed above with respect to FIG. 9. In general, at least some of the fibers of tuft 18 are tufted, aligned fibers 22 which can be described as having a significant or major vector component parallel to a Z-oriented plane orthogonal to transverse axis T.

The number, spacing, and size of tufts can be varied by changing the number, spacing, and size of teeth 110 and making corresponding dimensional changes as necessary to roll 104 and/or roll 102. This variation, together with the variation possible in precursor fibrous structures 28 and line speeds, permits many varied fibrous structure and/or fibrous products to be made for many purposes. For example, a fibrous structure and/or fibrous product made from a high basis weight textile fabric having MD and CD woven extensible threads could be made into a soft, porous ground covering, such as a cow carpet useful for reducing udder and teat problems in cows. A fibrous structure and/or fibrous product made from a relatively low basis weight nonwoven web of extensible spunbond polymer fibers could be used as a terry cloth-like fabric for semi-durable or durable clothing.

Figure 6:
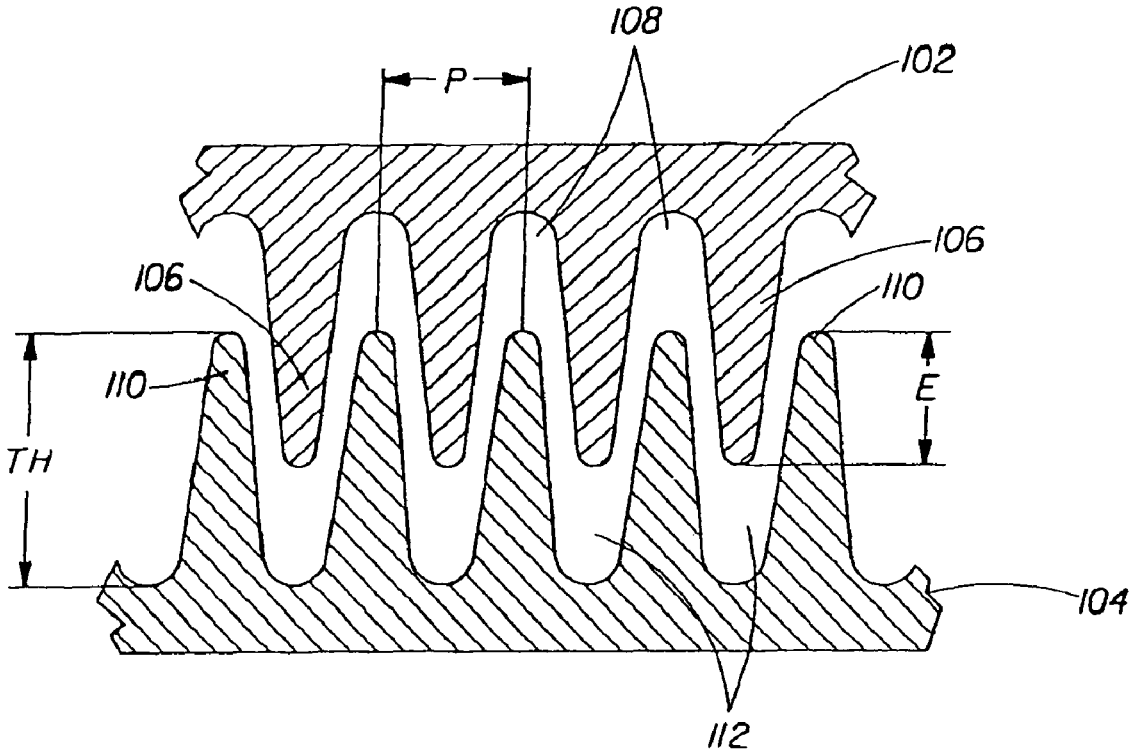
FIG. 6 is a cross-sectional depiction of a portion of the apparatus shown in FIG. 5.

FIG. 6 shows in cross section a portion of the intermeshing rolls 102 and 104 including ridges 106 and teeth 110. As shown teeth 110 have a tooth height TH (note that TH can also be applied to ridge 106 height; in a preferred example tooth height and ridge height are equal), and a tooth-to-tooth spacing (or ridge-to-ridge spacing) referred to as the pitch P. As shown, depth of engagement E is a measure of the level of intermeshing of rolls 102 and 104 and is measured from tip of ridge 106 to tip of tooth 110. The depth of engagement E, tooth height TH, and pitch P can be varied as desired depending on the properties of the precursor web and the desired characteristics of fibrous structure and/or fibrous product. For example, in general, to obtain tufted fibers in tuft 18, the greater the level of engagement E, the greater the necessary fiber mobility and/or elongation characteristics the fibers of the precursor web must possess. Also, the greater the density of the tufted regions desired (tufted regions per unit area of fibrous structure and/or fibrous product), the smaller the pitch should be, and the smaller the tooth length TL and tooth distance TD should be, as described below.

Figure 7:
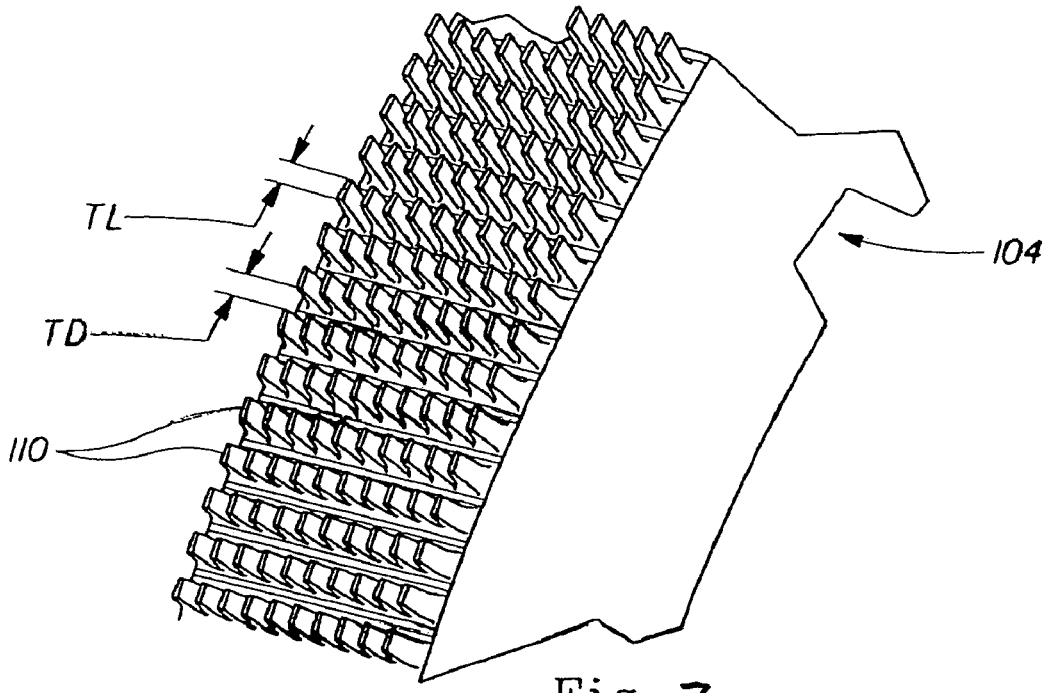
FIG. 7 is a perspective view of a portion of the apparatus for forming one example of a fibrous structure of the present invention.
Figure 8:
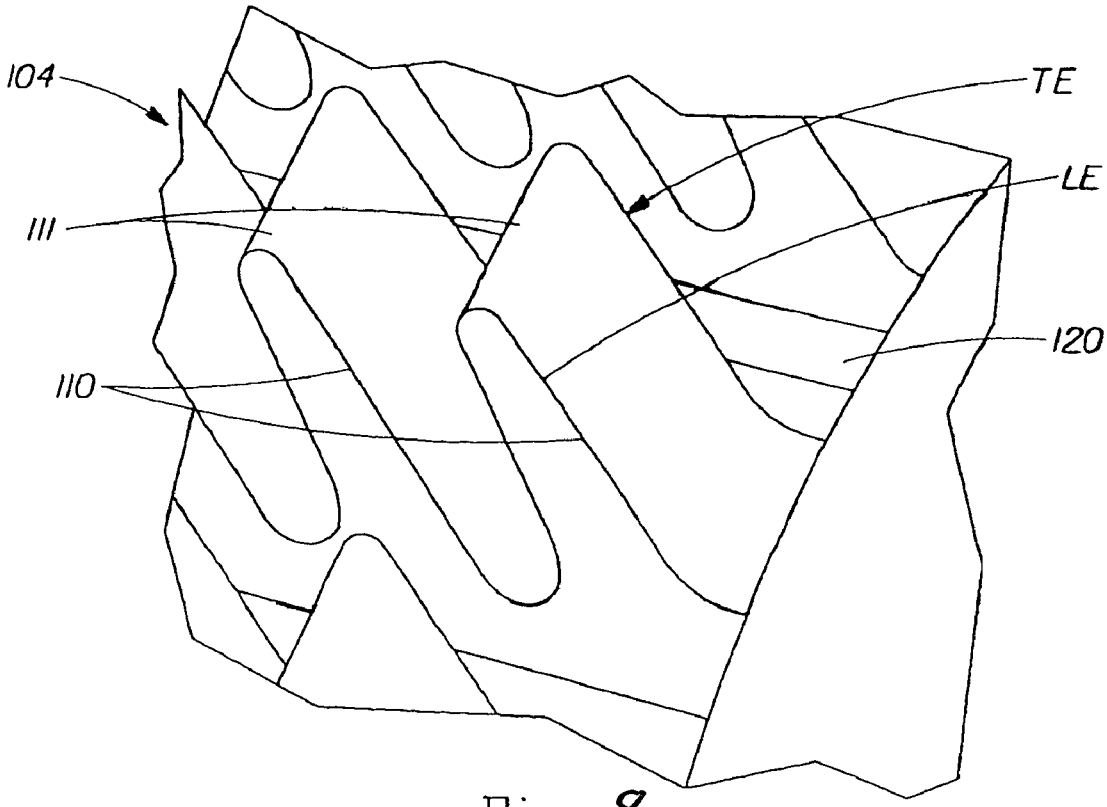
FIG. 8 is an enlarged perspective view of a portion of the apparatus for forming a fibrous structure of the present invention.

FIG. 7 shows one example of a roll 104 having a plurality of teeth 110 useful for making a fibrous structure and/or fibrous product of the present invention having a basis weight of between about 15 gsm and 100 gsm and/or from about 25 gsm to about 90 gsm and/or from about 30 gsm to about 90 gsm. In one example, the resulting fibrous structure and/or fibrous product exhibits a basis weight of from about 15 gsm to about 50 gsm and/or from about 15 gsm to about 40 gsm. An enlarged view of teeth 110 shown in FIG. 7 is shown in FIG. 8. In this example of roll 104 teeth 110 have a uniform circumferential length dimension TL of about 1.25 mm measured generally from the leading edge LE to the trailing edge TE at the tooth tip 111, and are uniformly spaced from one another circumferentially by a distance TD of about 1.5 mm. For making a fibrous structure and/or fibrous product from a precursor web having a basis weight in the range of about 15 gsm to 100 gsm, teeth 110 of roll 104 can have a length TL ranging from about 0.5 mm to about 3 mm and a spacing TD from about 0.5 mm to about 3 mm, a tooth height TH ranging from about 0.5 mm to about 10 mm, and a pitch P between about 1 mm (0.040 inches) and 2.54 mm (0.100 inches). Depth of engagement E can be from about 0.5 mm to about 5 mm (up to a maximum approaching the tooth height TH). Of course, E, P, TH, TD and TL can each be varied independently of each other to achieve a desired size, spacing, and area density of tufts (number of tufts per unit area of fibrous structure and/or fibrous product).

As shown in FIG. 8, each tooth 110 has a tip 111, a leading edge LE and a trailing edge TE. The tooth tip 111 is elongated and has a generally longitudinal orientation, corresponding to the longitudinal axes L of tufted regions. It is believed that to get the tufts of the fibrous structure and/or fibrous product that can be described as being terry cloth-like, the LE and TE should be very nearly orthogonal to the local peripheral surface 120 of roll 104. As well, the transition from the tip 111 and the LE or TE should be a sharp angle, such as a right angle, having a sufficiently small radius of curvature such that, in use the teeth 110 push through precursor web at the LE and TE. Without being bound by theory, it is believed that having relatively sharply angled tip transitions between the tip of tooth 110 and the LE and TE permits the teeth 110 to punch through precursor web "cleanly", that is, locally and distinctly, so that the resulting fibrous structure and/or fibrous product can be described as "tufted" in tufted regions rather than "embossed" for example. When so processed, the fibrous structure and/or fibrous product is not imparted with any particular elasticity, beyond what the precursor web may have possessed originally.

It has been found that line speed, that is, the rate at which precursor web is processed through the nip of rotating rolls 102 and 104, and the resulting rate of formation of tufts, impacts the structure of the resulting tufts.

Although the fibrous structure and/or fibrous product of the present invention is disclosed in preferred examples as a single ply fibrous structure and/or fibrous product made from a single ply precursor web, it is not necessary that it be so. For example, a laminate or composite precursor web having two or more plies can be used so long as one of the plies is a fibrous structure and/or fibrous product according to the present invention. In general, the above description for the fibrous structure and/or fibrous product holds, recognizing that tufted, aligned fibers, for example, formed from a laminate precursor web would be comprised of fibers from both (or all) plies of the laminate. In such a fibrous structure and/or fibrous product, it is important, therefore, that all the fibers of all the plies have sufficient diameter, elongation characteristics, and fiber mobility, so as not to break prior to extension and tufting. In this manner, fibers from all the plies of the laminate may contribute to the tufts. In a multilayer fibrous structure and/or fibrous product, the fibers of the different plies may be mixed or intermingled in the tuft and/or tufted regions. The fibers do not protrude through but combine with the fibers in an adjacent ply. This is often observed when the plies are processed at very high speeds.

Multi-ply fibrous structure and/or fibrous products can have significant advantages over single ply fibrous structure and/or fibrous products. For example, a tuft from a multi-ply fibrous structure and/or fibrous product using two or more precursor plies is shown schematically in FIGS. 9-10. As shown, both precursor plies 28' and 28" contribute fibers to tuft 18 in a "nested" relationship that "locks" the two precursor plies together, forming a laminate fibrous structure and/or fibrous product without the use or need of adhesives or thermal bonding or ultrasonic bonding or hydroentangling between the plies. However, if desired an adhesive, chemical bonding, resin or powder bonding, or thermal bonding or ultrasonic bonding or hydroentangling and combinations thereof between the plies can be selectively utilized to certain regions or all of the precursor plies. In addition, the multiple plies may be bonded during processing by any suitable bonding method by applying an adhesive or by thermal bonding without the addition of a separate adhesive. Also, bonding may be achieved by physically subjecting the two plies to the tuft generating process such that tufts, especially tufts from at least one ply protrude through the other ply. In a preferred example, the tuft 18 retains the ply relationship of the laminate precursor web, as shown in FIG. 9, and in all preferred examples the upper ply (specifically ply 28' in FIGS. 9-10, but in general the top ply with reference to the z-axis as shown in FIGS. 9-10) remains substantially intact and forms tufted fibers 22.

In a multi-ply fibrous structure and/or fibrous product 10' each precursor ply can have different properties. For example, as shown in FIGS. 9-10, multi-ply fibrous structure and/or fibrous products 10' can comprise two (or more) precursor fibrous structures (at least one of the precursor fibrous structures is a fibrous structure according to the present invention), e.g., first and second precursor webs 28' and 28". First precursor web 28' can form an upper ply exhibiting high elongation and significant elastic recovery which enables the precursor web 28' to spring back. The spring back or lateral squeeze that results from precursor web 28' spring back aids in securing and stabilizing the z-axis oriented fibers in the tuft 18. The lateral squeeze provided by precursor web 28' can also increase the stability of the second precursor web 28".

Figure 9:
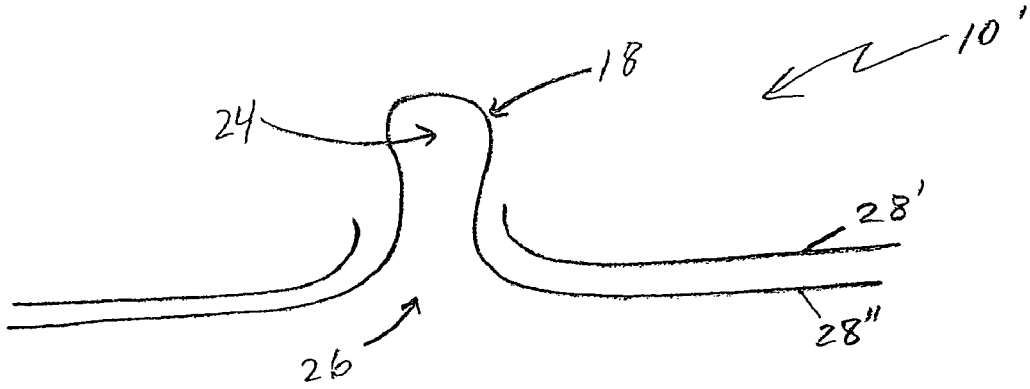
FIG. 9 is a schematic representation of a portion of a fibrous product of the present invention.
Figure 10:
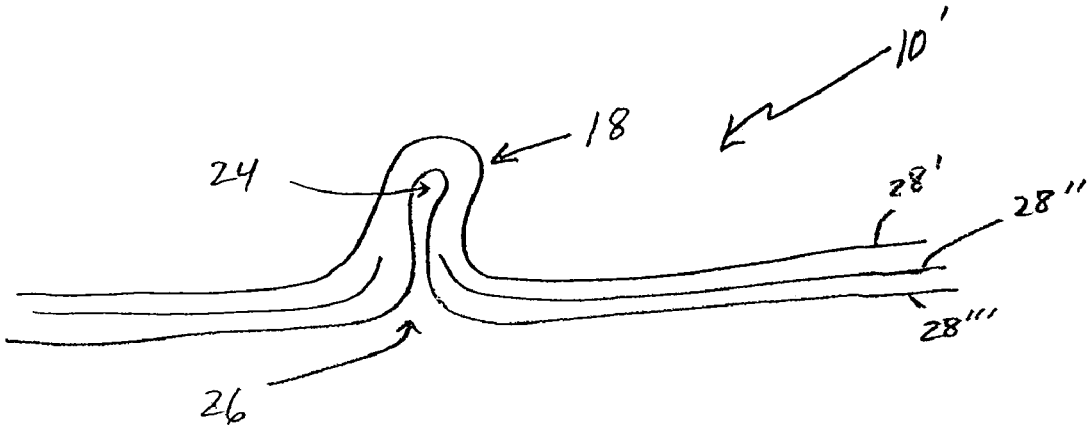
FIG. 10 is another schematic representation of a portion of a fibrous product of the present invention.

As shown in FIG. 9, the multi-ply fibrous structure and/or fibrous product 10' of the present invention comprises a first precursor web 28' and a second precursor web 28". The second precursor web 28" forms a tuft 18 that protrudes through the first precursor web 28'.

As shown in FIG. 10, the multi-ply fibrous structure and/or fibrous product 10' of the present invention comprises a first precursor web 28', a second precursor web 28" and a third precursor web 28'''. The third precursor web 28''' forms a tuft 18 that protrudes through the second precursor web 28" and only into the first precursor web 28'.

In all of the multi-ply fibrous structure and/or fibrous product examples illustrated in FIGS. 9-10, the formation of the tufts results in a discontinuity 26 and an open void area 24.

The fibrous structure and/or fibrous products of the present invention, addition to being used as web products, may also be used for a wide variety of other applications. Nonlimiting examples of such other applications include various filter sheets such as air filter, bag filter, liquid filter, vacuum filter, water drain filter, and bacterial shielding filter; sheets for various electric appliances such as capacitor separator paper, and floppy disk packaging material; beach mat; various industrial sheets such as tacky adhesive tape base cloth, oil absorbing material, and paper felt; various wiper sheets such as wipers for homes, services and medical treatment, printing roll wiper, wiper for cleaning copying machine, and wiper for optical systems; hygiene or personal cleansing wiper such as baby wipes, feminine wipes, facial wipes, or body wipes, various medicinal and sanitary sheets, such as surgical gown, gown, covering cloth, cap, mask, sheet, towel, gauze, base cloth for cataplasm, diaper, diaper core, diaper acquisition layer, diaper liner, diaper cover, base cloth for adhesive plaster, wet towel, and tissue; various sheets for clothes, such as padding cloth, pad, jumper liner, and disposable underwear; various life material sheets such as base cloth for artificial leather and synthetic leather, table top, wall paper, shoji-gami (paper for paper screen), blind, calendar, wrapping, and packages for drying agents, shopping bag, suit cover, and pillow cover; various agricultural sheets, such as cow carpets, cooling and sun light-shielding cloth, lining curtain, sheet for overall covering, light-shielding sheet and grass preventing sheet, wrapping materials of pesticides, underlining paper of pots for seeding growth; various protection sheets such as fume prevention mask and dust prevention mask, laboratory gown, and dust preventive clothes; various sheets for civil engineering building, such as house wrap, drain material, filtering medium, separation material, overlay, roofing, tuft and carpet base cloth, wall interior material, soundproof or vibration reducing sheet, and curing sheet; and various automobile interior sheets, such as floor mat and trunk mat, molded ceiling material, head rest, and lining cloth, in addition to a separator sheet in alkaline batteries.

Another advantage of the process described to produce the fibrous structure and/or fibrous products of the present invention is that the fibrous structure and/or fibrous products can be produced in-line with other fibrous structure and/or fibrous product production equipment. Additionally, there may be other solid state formation processes that can be used either prior to or after the process of the present invention. Nonlimiting examples of suitable solid state formation processes include printing, embossing, laminating, slitting, perforating, cutting edges, stacking, folding, and the like.

As can be understood from the above description of the fibrous structure and/or fibrous products and methods for making such fibrous structure and/or fibrous product of the present invention, many various fibrous structure and/or fibrous products can be made without departing from the scope of the present invention as claimed in the appended claims. For example, fibrous structure and/or fibrous products can be coated or treated with lotions, medicaments, cleaning fluids, anti-bacterial solutions, emulsions, fragrances, surfactants.

Test Methods

Effective Caliper Test

Effective caliper of a fibrous structure and/or sanitary tissue product in roll form is determined by the following equation:

$$EC=(RD^2-CD^2)/(0.00127\times SC\times SL)$$

wherein EC is effective caliper in mils of a single sheet in a wound roll of fibrous structure and/or sanitary tissue product; RD is roll diameter in inches; CD is core diameter in inches; SC is sheet count; and SL is sheet length in inches.

Horizontal Full Sheet (HFS) Absorbency Test

The Horizontal Full Sheet (HFS) test method determines the amount of distilled water absorbed and retained by the paper of the present invention. This method is performed by first weighing a sample of the paper to be tested (referred to herein as the "Dry Weight of the paper"), then thoroughly wetting the paper, draining the wetted paper in a horizontal position and then reweighing (referred to herein as "Wet Weight of the paper"). The absorptive capacity of the paper is then computed as the amount of water retained in units of grams of water absorbed by the paper. When evaluating different paper samples, the same size of paper is used for all samples tested.

The apparatus for determining the HFS capacity of paper comprises the following: An electronic balance with a sensitivity of at least ±0.01 grams and a minimum capacity of 1200 grams. The balance should be positioned on a balance table and slab to minimize the vibration effects of floor/benchtop weighing. The balance should also have a special balance pan to be able to handle the size of the paper tested (i.e.; a paper sample of about 11 in. (27.9 cm) by 11 in. (27.9 cm)). The balance pan can be made out of a variety of materials. Plexiglass is a common material used.

A sample support rack and sample support cover is also required. Both the rack and cover are comprised of a lightweight metal frame, strung with 0.012 in. (0.305 cm) diameter monofilament so as to form a grid of 0.5 inch squares (1.27 $cm^2$). The size of the support rack and cover is such that the sample size can be conveniently placed between the two.

The HFS test is performed in an environment maintained at 23±1° C. and 50±2% relative humidity. A water reservoir or tub is filled with distilled water at 23±1° C. to a depth of 3 inches (7.6 cm).

The paper to be tested is carefully weighed on the balance to the nearest 0.01 grams. The dry weight of the sample is reported to the nearest 0.01 grams. The empty sample support rack is placed on the balance with the special balance pan described above. The balance is then zeroed (tared). The sample is carefully placed on the sample support rack. The support rack cover is placed on top of the support rack. The sample (now sandwiched between the rack and cover) is submerged in the water reservoir. After the sample has been submerged for 60 seconds, the sample support rack and cover are gently raised out of the reservoir.

The sample, support rack and cover are allowed to drain horizontally for 120±5 seconds, taking care not to excessively shake or vibrate the sample. Next, the rack cover is carefully removed and the wet sample and the support rack are weighed on the previously tared balance. The weight is recorded to the nearest 0.01 g. This is the wet weight of the sample.

The gram per paper sample absorptive capacity of the sample is defined as (Wet Weight of the paper−Dry Weight of the paper).

All documents cited in the Detailed Description of the Invention are, in relevant part, incorporated by reference herein; the citation of any document is not to be construed as an admission that it is prior art with respect to the present invention. To the extent that any meaning or definition of the term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A single-ply fibrous structure comprising at least two chemically different compositions, at least one of which is in the form of a fiber, wherein one of the at least two chemically different compositions is present in the fibrous structure as a first layer and the other of the at least two chemically different compositions is present in the fibrous structure as a second layer, wherein the fibrous structure comprises a plurality of tufts formed by the second layer protruding through the first layer and wherein the tufts each comprise a continuous loop that defines an open void area tunnel.

2. The single-ply fibrous structure according to claim 1 wherein the fiber comprises a natural fiber.

3. The single-ply fibrous structure according to claim 2 wherein the natural fiber is selected from the group consisting of: wool, wood fibers, cotton, flax, jute, silk, annual grass fibers and mixtures thereof.

4. The single-ply fibrous structure according to claim 2 wherein the natural fiber comprises a cellulosic fiber.

5. The single-ply fibrous structure according to claim 4 wherein the cellulosic fiber is selected from the group consisting of: hardwood fibers, softwood fibers, annual grass fibers and mixtures thereof.

6. The single-ply fibrous structure according to claim 1 wherein the fiber comprises a synthetic thermoplastic polymer fiber.

7. The single-ply fibrous structure according to claim 6 wherein the synthetic thermoplastic polymer fiber comprises a material selected from the group consisting of: polyethylene terephthalate, polyethylene terephthalate/co-polyethylene terephthalate, polyethylene, polypropylene, polyesters, polyolefins, polyamides, polyacrylates, polyhydroxyalkanoates, polylactic acids and mixtures thereof.

8. The single-ply fibrous structure according to claim 6 wherein the synthetic thermoplastic polymer fiber exhibits an average fiber length of less than about 50 mm.

9. The single-ply fibrous structure according to claim 1 wherein one of the chemically different compositions comprises a natural fiber and the other of the chemically different compositions comprises a synthetic thermoplastic polymer fiber.

10. The single-ply fibrous structure according to claim 1 wherein one of the at least two chemically different compositions is present in a non-fiber form.

11. The single-ply fibrous structure according to claim 1 at least one of the at least two chemically different compositions comprises a thermoplastic polymer.

12. The single-ply fibrous structure according to claim 11 wherein the thermoplastic polymer is in a form selected from the group consisting of: films, fibers, continuous scrim, discontinuous scrim, semi-continuous scrim, discrete areas and mixtures thereof.

13. A layered fibrous product comprising a ply comprising at least two layers, wherein one of the at least two layers comprises a fiber, wherein one of the at least two layers protrudes through another of the at least two layers forming a plurality of tufts, wherein the tufts each comprise a continuous loop that defines an open void area tunnel.

14. The layered fibrous product according to claim 13 wherein at least one of the layers comprises a layered cellulosic fibrous structure.

15. The layered fibrous product according to claim 13 wherein at least one of the layers comprises a cellulosic fibrous structure selected from the group consisting of: wet laid fibrous structure, differential density fibrous structures, differential basis weight fibrous structures, through-air-dried fibrous structures, uncreped through-air-dried fibrous structures, creped fibrous structures, conventionally dried fibrous structures and mixtures thereof.

16. The layered fibrous product according to claim 13 wherein at least one of the layers is selected from the group consisting of: unbonded airlaid, thermal bonded air laid fibrous structures, mixed bonded air laid fibrous structures, latex bonded air laid fibrous structures, or co-formed fibrous structure.

* * * * *